US006843035B1

(12) United States Patent
Glynn

(10) Patent No.: US 6,843,035 B1
(45) Date of Patent: Jan. 18, 2005

(54) TRACK COMPONENT FOR FABRICATING A DEFLECTION WALL

(76) Inventor: William J. Glynn, 18 Kensington Rd., Garden City, NY (US) 11530

( * ) Notice: Subject to any disclaimer, the term of this patent is extended or adjusted under 35 U.S.C. 154(b) by 0 days.

(21) Appl. No.: 10/409,396

(22) Filed: Apr. 8, 2003

(51) Int. Cl.[7] ..... E04B 1/343; E04B 2/30
(52) U.S. Cl. ..... 52/573.1; 52/481.1; 52/483.1
(58) Field of Search ..... 52/475.1, 481.1, 52/483.1, 573.1, 243

(56) References Cited

U.S. PATENT DOCUMENTS

| | | | | |
|---|---|---|---|---|
| 1,549,671 A | | 8/1925 | Kridler et al. | |
| 2,056,328 A | * | 10/1936 | Price | 52/243 |
| 2,058,386 A | * | 10/1936 | Parsons | 52/290 |
| 2,567,586 A | | 9/1951 | Werder | |
| 2,744,334 A | | 5/1956 | Jondole | |
| 3,169,320 A | | 2/1965 | Currie | |
| 3,423,893 A | | 1/1969 | Hyatt | |
| 3,460,298 A | * | 8/1969 | Sowinski | 52/98 |
| 3,888,059 A | | 6/1975 | Maclennan et al. | |
| 4,322,064 A | | 3/1982 | Jarvis | |
| 4,625,415 A | | 12/1986 | Diamontis | |
| 5,040,345 A | * | 8/1991 | Gilmour | 52/243.1 |
| 5,127,760 A | * | 7/1992 | Brady | 403/230 |
| 5,129,153 A | | 7/1992 | Burns, Sr. | |
| 5,274,973 A | * | 1/1994 | Liang | 52/243 |
| 5,313,752 A | * | 5/1994 | Hatzinikolas | 52/243 |
| 5,367,783 A | | 11/1994 | Nygren | |
| 5,768,795 A | | 6/1998 | Jimenez | |
| 5,906,080 A | * | 5/1999 | diGirolamo et al. | 52/243.1 |
| 6,176,053 B1 | * | 1/2001 | St. Germain | 52/232 |
| 6,401,423 B1 | * | 6/2002 | Bergeron et al. | 52/733.3 |
| 6,612,087 B2 | * | 9/2003 | diGirolamo et al. | 52/712 |
| 2003/0074849 A1 | * | 4/2003 | Surowiecki | |
| 2004/0003564 A1 | * | 1/2004 | Surowiecki | |

* cited by examiner

*Primary Examiner*—Anita King
*Assistant Examiner*—Jon Szumny
(74) *Attorney, Agent, or Firm*—Richard L. Miller

(57) ABSTRACT

A deflection wall. Channel-shaped studs are physically attached to a channel-shaped sole plate, but floatingly attached to a channel-shaped top plate. The webs, of the sole and top plates have tabs stamped therefrom which are spaced longitudinally therealong at predetermined intervals so as to provide for desired spacing of the studs. A tab of the sole plate is physically attached to either the web or a flange of the stud and a tab of the top plate abuts against, but is not physically attached to, one side of the web of the stud so as to allow the stud to axially float. To prevent lateral floating of the stud, either an angle plate sandwiches the web of the stud between the tab of the top plate and itself, the flanges of the stud are cut and wrapped around, so as to abuttingly engage against, the tab of the top plate, or the tab of the top plate is split heightwise into a pair of tabs that straddlingly engage the web of the stud.

10 Claims, 3 Drawing Sheets

TRACK COMPONENT FOR FABRICATING A DEFLECTION WALL

BACKGROUND OF THE INVENTION

1. Field of the Invention

The present invention relates to a wall. More particularly, the present invention relates to a track component for fabricating a deflection wall, and the deflection wall which is a direct result of such fabricating track component.

2. Description of the Prior Art

As shown in FIG. 1, a conventional wall 1 includes a stud 2 physically attached by screws 3 to a top plate 4, and in so doing, the stud 2 is prevented from axial movement relative to the top plate 4.

Numerous innovations for construction related devices have been provided in the prior art that will be described. Even though these innovations may be suitable for the specific individual purposes to which they address, however, they differ from the present invention.

A FIRST EXAMPLE, U.S. Pat. No. 1,549,671 to Kridler et al. teaches a gauge comprising a bar, rafter-engageable brackets carried on opposite ends of said bar, and furring strip spacers disposed in longitudinal spaced relation on said bar.

A SECOND EXAMPLE, U.S. Pat. No. 2,567,586 to Werder teaches a layout template for assembling and nailing timbers together comprising an elongated angle iron, one flange of said angle iron being provided at longitudinally spaced points with timber openings each of which is adapted to accommodate and seat an end portion of a coacting piece of timber and being further provided, on opposite sides of each opening with a pair of outstanding spaced parallel timber positioning and racking lugs.

A THIRD EXAMPLE, U.S. Pat. No. 2,744,334 to Jondole teaches a gauge comprising a pair of end plates spacing means rigidly connected to the end plates and maintaining said plates in spaced parallel relationship, and a pair of substantially L-shaped gauge members secured to the spacing means with each member having one leg of the L lying in spaced parallel relationship to a different one of the end plates to form therewith a substantially U-shaped channel extending transversely of the spacing means with the channels being adapted to receive and support a pair of studs in laterally spaced parallel relationship.

A FOURTH EXAMPLE, U.S. Pat. No. 3,169,320 to Currie teaches a framework layout tool for use in marking a first piece of timber at equally spaced points therealong to which other timbers are to be secured, said tool comprising an elongated straight header member, a set of five parallel branch members of identical width adapted to equal the thickness of said other timbers projecting laterally outwardly from one side edge of said header member, said branch members being positioned at five consecutive predetermined positions spaced longitudinally along said header member, the first, second, fourth and fifth positions being equally spaced apart and the third position being equally spaced apart and third position being spaced equally between said second and fourth positions as well as equally between said first and fifth positions; one of said first and fifth branch members being positioned adjacent corresponding end of said header member and spaced from said corresponding end a distance equal to one-half the width of said one branch member.

A FIFTH EXAMPLE, U.S. Pat. No. 3,423,893 to Hyatt teaches a row of studs uniformly spaced apart longitudinally of the row in which each stud is a pair of vertically, parallel stud members in side-by-side relation uniformly spaced apart transversely of the row with said stud members held at their ends independently of each other against relative movement transversely of and out of said row and against twisting about their vertical axes to provide coplanar surfaces at opposite sides of said row for securement of wall panels thereto, with the spaces between the stud members reducing transmission of sound across the partition.

A SIXTH EXAMPLE, U.S. Pat. No. 3,888,059 to MacLennan et al. teaches a removable partition wall construction including an upper generally U-shaped channel member having a base portion and a pair of transversely spaced longitudinally extending a dependent leg portions and a least one vertically extending stud member having a generally I cross-sectional configuration, each stud comprising a pair of spaced side webs joined by a transverse cross web, the side webs of the upper end of each stud being located within and parallel to the leg portions of said channel member, each stud including guide means adjacent the upper end thereof and a member vertically slidable in said guide means, said member being connected to the base portion of said channel member whereby reaction loads are transferred from the stud to the base of said channel member. The present invention also provides a stud for use in said wall partitions.

A SEVENTH EXAMPLE, U.S. Pat. No. 4,322,064 to Jarvis teaches a plurality of serially-disposed and pivotally-connected elements that comprise the object-spacing tool of the present invention. The tool can be compactly folded to a size approximately the length of one element or expanded to a length approximately the total length of all the elements. Each element has two members projecting therefrom; typically, each projecting member is at or near an end of the element. Each projecting member is constructed to cooperate with a projecting member from an adjacent element for clamping an object therebetween. These cooperating pairs of projecting elements are spaced a fixed distance from each other, thereby spacing the objects clamped therebetween a predetermined distance from each other.

AN EIGHTH EXAMPLE, U.S. Pat. No. 4,625,415 to Diamontis teaches a stud spacer for construction work comprising a rigid support to which spacers are fixed at longitudinally spaced intervals corresponding to the distance between studs to hold the latter at the desired spacing while the studs are being secured.

A NINTH EXAMPLE, U.S. Pat. No. 5,129,153 to Burns, Sr. teaches a structural member spacing tool that is adapted to be disposed between adjacent structural members for positioning the structural members a predetermined distance apart. The tool acts as a support to prevent movement of the structural members while they are fastened in place. The tool is provided with parallel, spaced apart support surfaces which provide rigid support within a stud cavity between adjacent stud members. This allows the tool to prevent movement of the studs while they are fastened in place. Since the tool is disposed within the stud cavity, it can be utilized in any stud cavity including the cavity adjacent a corner. The tool can also be used for walls adapted to be constructed flush against a masonry wall.

A TENTH EXAMPLE, U.S. Pat. No. 5,367,783 to Nygren teaches a layout tool that la used for marking the positions for building materials, such as studs, Joists, rafters, trusses and rough door opening trimmer studs, before nailing in permanent position on wall plates and sill plates. The layout tool has templates that are the same width of building materials, that are attached at indicia markings, "on center", from either end of an extruded member and the interlocking design of the manufacture keeps them perpendicular. Also provided are the rough door sizes that are indicia marked and layout can be marked from either end of invention.

AN ELEVENTH EXAMPLE, U.S. Pat. No. 5,768,795 to Jimenez teaches a stud template which comprises a generally rectangular elongate flat blade sized to cover the width of a plurality of side by side sole plates before installation. An elongate T-shaped member is integrally formed along one long side of the flat blade. The T-shaped member can engage a longitudinal edge of one of the outermost sole plates. A facility is for repetitively marking a series of stud locations stations along the length of the sole plates simultaneously. When the sole plates are installed in a wall frame of a building, studs can be erected upon the stud location stations on the sole plates quickly and without error.

It is apparent that numerous innovations for construction related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a track component for fabricating a deflection wall that avoids the disadvantages of the prior art.

ANOTHER OBJECT of the present invention is to provide a track component for fabricating a deflection wall that is simple to use.

BRIEFLY STATED, STILL ANOTHER OBJECT of the present invention is to provide a deflection wall and a track component for fabricating the deflection wall, which may serve either as a sole plate when used at the bottom edge of a wall or as a top plate when used at the top edge of a wall. Channel-shaped studs are physically attached to a channel-shaped sole plate, but floatingly attached to a channel-shaped top plate. The webs of the sole and top plates have tabs stamped therefrom which are spaced longitudinally therealong at predetermined intervals so as to provide for desired spacing of the studs. A tab of the sole plate is physically attached to either the web or a flange of the stud and a tab of the top plate abuts against, but is not physically attached to, one side of the web of the stud so as to allow the stud to axially float. To prevent lateral floating of the stud, either an angle plate sandwiches the web of the stud between the tab of the top plate and itself, the flanges of the stud are cut and wrapped around, so as to abuttingly engage against, the tab of the top plate, or the tab of the top plate is split heightwise into a pair of tabs that straddlingly engage the web of the stud.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Prior Art

Figure 1:
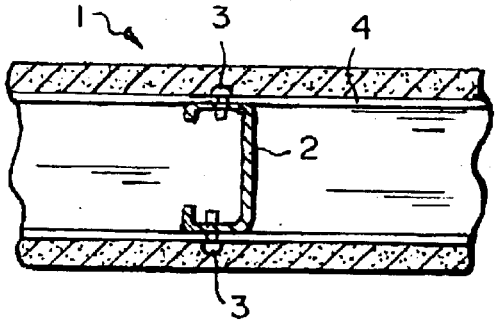
PRIOR ART Fig. 1
FIG. 1 is a diagrammatic cross sectional view of a stud physically attached to a portion of a top plate in a conventional prior art wall.

1 conventional wall
2 stud
3 screws
4 top plate

Present Invention

20 deflection wall of present invention
22 sole plate
24 studs
26 top plate
28 web of each of sole plate 22 and top plate 26

30 pair of flanges of each of sole plate 22 and top plate 26
32 tabs stamped from each of sole plate 22 and top plate 26
34 through bore in each tab of tabs 32 of sole plate 22
38 web of each stud of studs 24
40 pair of flanges of each stud of studs 24
41 screw
42 angle plate
44 one leg of angle plate 42
46 other leg of angle plate 42
48 screw
49 horizontally cut on flange 40

Second Embodiment

222 sole plate
226 top plate
228 web of each of sole plate 222 and top plate 226
230 pair of flanges of each of sole plate 222 and top plate 226
236 segments of each of sole plate 222 and top plate 226

Third Embodiment

332 pair of tabs of tab 32 of top plate 26

Detailed Description of the Preferred Embodiment

Figure 2:
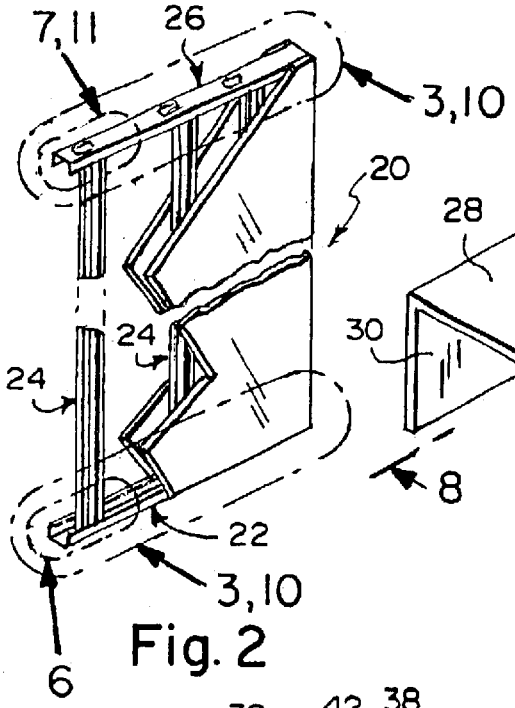
FIG. 2 is a diagrammatic perspective view, with parts broken away, of the deflection wall of the present invention.

Referring now to the figures, in which like numerals indicate like parts, and particularly to FIG. 2, the deflection wall fabricated utilizing the present invention is shown generally at 20. The deflection wall 20 comprises a sole plate 22, studs 24, and a top plate 26. The studs 24 are physically attached to the sole plate 22 and floatingly attached to the top plate 26.

The sole plate 22, the studs 24, and the top plate 26 are metallic.

The specific configuration of a first embodiment of the sole plate 22 and the top plate 26 can best be seen in FIGS. 3, 4, and 4A, and as such, will be discussed with reference thereto.

Figure 3:
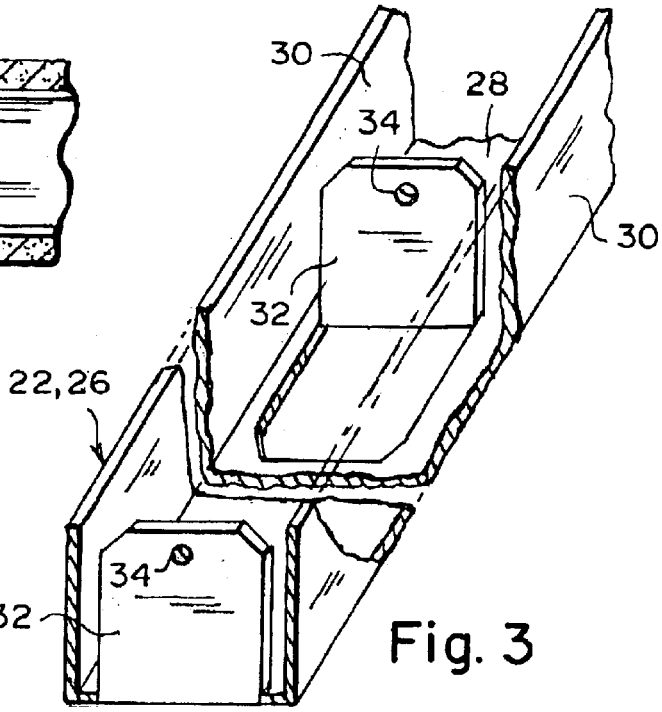
FIG. 3 is an enlarged diagrammatic perspective view, with parts broken away and in section, of an area generally enclosed by a dotted curve identified by arrows 3 in FIG. 2 of a sole plate or a top plate of a first embodiment of a straight deflection wall of the present invention shown in FIG. 2.
Figure 4:
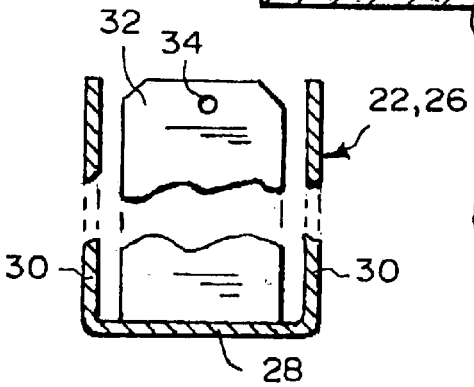
FIG. 4 is a diagrammatic cross sectional end view, with parts broken away, taken generally in the direction of arrow 4 in FIG. 3.

As shown in FIGS. 3 and 4, the sole plate 22 is identical to the top plate 26, and each is straight and channel-shaped, and as a result thereof, has a web 28 and a pair of flanges 30.

The webs 28 of each of the sole plate 22 and the top plate 26 have tabs 32 stamped therefrom and spaced longitudinally therealong at predetermined intervals so as to provide for desired spacing of the studs 24. The tabs 32 extend perpendicularly upwardly from the sole plate 22 and perpendicularly downwardly from the top plate 26.

Each of the tabs 32 of the sole plate 22 has a through bore 34 extending transversely therethrough, whose purpose will be discussed later.

Figure 4A:
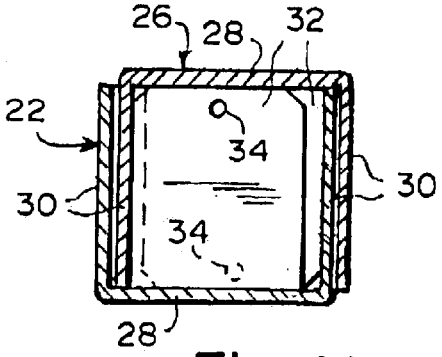
FIG. 4A is a diagrammatic cross sectional end view taken generally in the direction of arrow 4A in FIG. 3 of a pair of plates of the deflection wall of the present invention inversely interlockingly stacked together for transport and for concealing therein the sharp edged tabs thereon.

As shown in FIG. 4A, a pair of plates 22, 26, or 22 and 26 are inversely interlockingly stacked together for transport and for concealing therein the tabs 32 thereon that have sharp edges.

Figure 5:
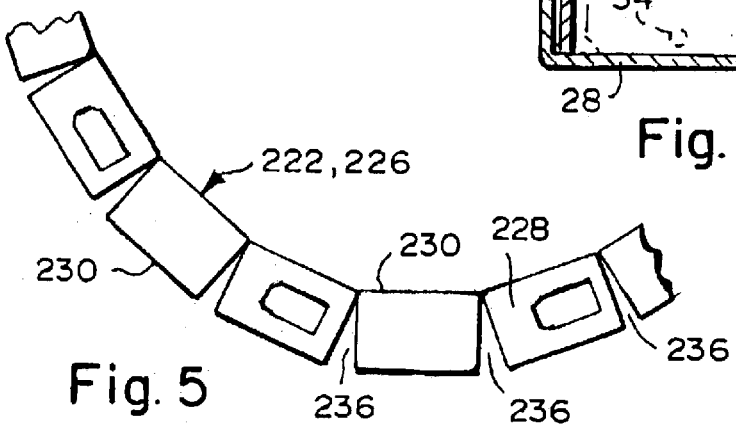
FIG. 5 is an diagrammatic top plan view of a portion of a sole plate or a top plate of a second embodiment of a curved deflection wall of the present invention.

The specific configuration of a second embodiment of the sole plate 222 and the top plate 226 can best be seen in FIG. 5, and as such, will be discussed with reference thereto.

The sole plate 222 and the top plate 226 are identical to the sole plate 22 and the top plate 26, except that they are curved by having segments 236 thereof cut out from adjacent portions of the web 228 thereof and a flange 230 thereof and then bent along the other flange 230 thereof.

Figure 6:
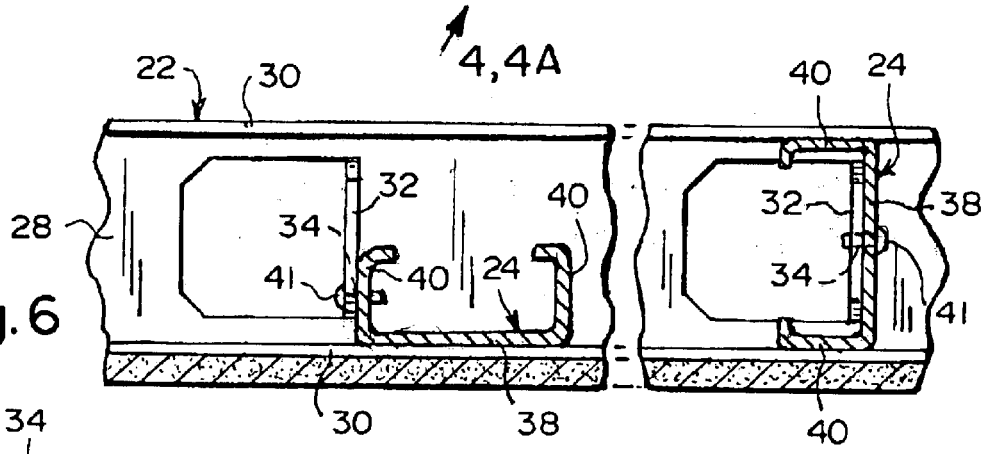
FIG. 6 is an enlarged diagrammatic top plan view with parts in section of an area generally enclosed by a dotted curve identified by arrow 6 in FIG. 2 of the studs physically attached to the sole plate of the deflection wall of the present invention shown in FIG. 2.

The specific configuration of the studs 24 and their interaction with the sole plate 22 can best be seen in FIG. 6, and as such, will be discussed with reference thereto.

Each stud 24 is channel-shaped, and as a result thereof, has a web 38 and a pair of flanges 40.

A stud 24 is physically attached to the sole plate 22 by a tab 32 of the sole plate 22 being physically attached to one of the web 38 and a flange 40 of the stud 24 by a screw 41 passing through the through bore 34 in the tab 32 and threadably engaging in the stud 24.

The web 38 of the stud 24 abuts against a flange 30 of the sole plate 22 when the tab 32 of the sole plate 22 is physically attached to the flange 40 of the stud 24, and the flanges 40 of the stud 24 abut against the flanges 30 of the sole plate 22 when the tab 32 of the sole plate 22 is physically attached to the web 38 of the stud 24.

Figure 8:
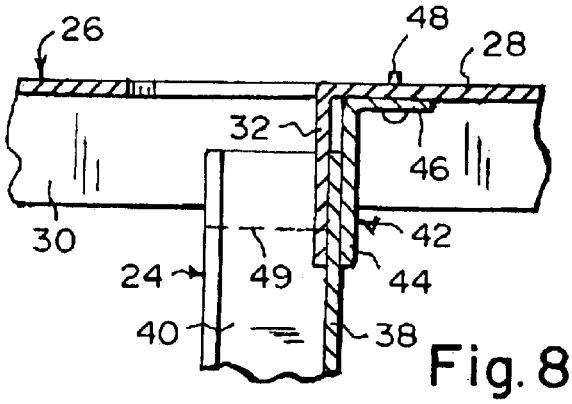
FIG. 8 is a diagrammatic cross sectional view taken along line 8—8 in FIG. 7 illustrating use of an angle plate to prevent laterally floating of the stud relative to the top plate of the deflection wall of the present invention.
Figure 7:
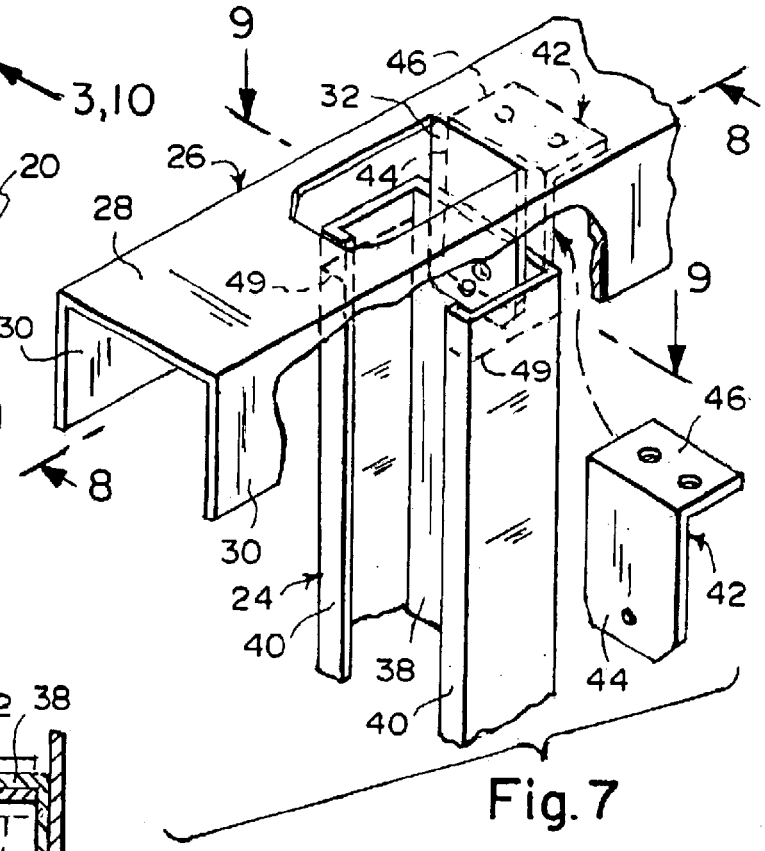
FIG. 7 is an enlarged diagrammatic perspective view, with parts broken away in section of an area generally enclosed by a dotted curve identified by arrow 7 in FIG. 2 of the stud floatingly attached to the top plate of the deflection wall of the present invention.

The specific configuration of a first embodiment of the interaction of the studs 24 with the top plate 26 can best be seen in FIGS. 7 and 8, and as such, will be discussed with reference thereto.

A stud 24 receives a tab 32 of the top plate 26. The tab 32 of the top plate 26 abuts against one side of the web 38 of the stud 24, with the flanges 40 of the stud 24 abutting against the flanges 30 of the top plate 26.

The tab 32 of the top plate 26 is not physically attached to the web 38 of the stud 24 so as to allow the stud 24 to axially float.

The deflection wall 20 further comprises an angle plate 42. The angle plate 42 has one leg 44 thereof abutted against the other side of the web 38 of the stud 24 so as to sandwich the web 38 of the stud 24 between the tab 32 of the top plate 26 and the one leg 44 of the angle plate 42 and prevent lateral floating of the stud 24, while the other leg 46 of the angle plate 42 is physically attached by a screw 48 to the web 28 of the top plate 26 to maintain the angle plate 42 in position.

Figure 9:
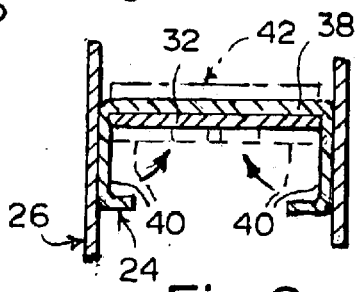
FIG. 9 is a diagrammatic cross sectional view taken along line 9—9 in FIG. 7.

The specific configuration of a second embodiment of the interaction of the studs 24 with the top plate 26 can best be seen in FIGS. 8, and 9, and as such, will be discussed with reference thereto.

The second embodiment is identical to the first embodiment, except that the angle plate 42 is eliminated, and in its place, the flanges 40 of each stud 24 are horizontally cut at 49 and wrapped around, so as to abuttingly engage against, the tab 32 of the top plate 26.

Figure 11:
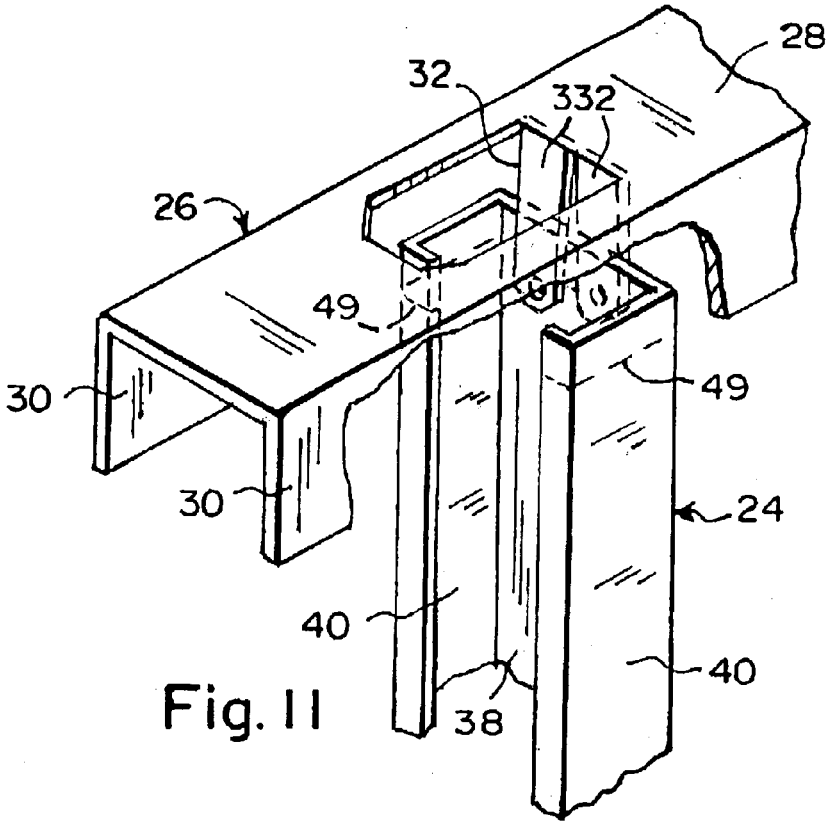
FIG. 11 is an enlarged diagrammatic perspective view, with parts broken away and in section, of the area generally enclosed by the dotted curve identified by arrow 11 in FIG. 2 of the stud floatingly attached to the top plate of the third embodiment of the deflection wall of the present invention.
Figure 10:
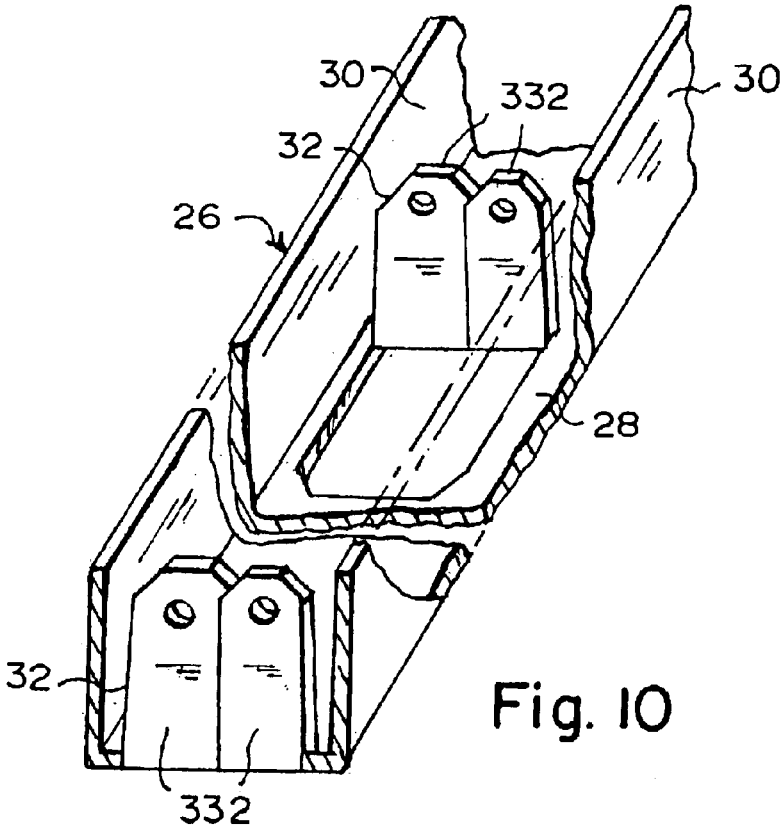
FIG. 10 is an enlarged diagrammatic perspective view, with parts broken away and in section, of an area generally enclosed by a dotted curve identified by arrows 10 in FIG. 2 of a sole plate or a top plate of a third embodiment of the deflection wall of the present invention shown in FIG. 2.

The specific configuration of a third embodiment of the interaction of the studs 24 with the top plate 26 can best be seen in FIGS. 10 and 11, and as such, will be discussed with reference thereto.

The third embodiment is identical to the first embodiment, except that the angle plate 42 is eliminated, and in its place, the tab 32 of the top plate 26 is split heightwise into a pair of tabs 332 that straddlingly engage the web 38 of the stud 24.

The pair of tabs 332 are chamfered to facilitate insertion of the web 38 of the stud 24 therebetween, into the split in the tab 32 of the top plate 26.

It will be understood that each of the elements described above, or two or more together, may also find a useful application in other types of constructions differing from the types described above.

While the invention has been illustrated and described as embodied in a deflection wall, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A deflection wall, comprising:

a) a sole plate;

b) studs; and c) a top plate;

wherein said studs are physically attached to said sole plate;

wherein said studs are floatingly attached to said top plate;

wherein said sole plate is channel-shaped;

wherein said sole plate has a web;

wherein said sole plate has a pair of flanges;

wherein said top plate is channel-shaped;

wherein said top plate has a web;

wherein said top plate has a pair of flanges;

wherein said web of said sole plate has tabs;

wherein said web of said top plate has tabs;

wherein each of said tabs of said sole plate has a through bore;

wherein said through bore in each of said tabs of said sole plate extends transversely therethrough;

wherein each stud is channel-shaped;

wherein each stud hap a web;

wherein each stud has a pair of flanges;

wherein a stud is physically attached to said sole plate by a tab of said sole plate being physically attached to one of said web and a flange of said stud by a screw passing through said through bore in said tab and threadably engaging in said stud;

wherein said web of said stud abuts against a flange of said sole plate when said tab of said sole plate is physically attached to said flange of said stud; and wherein said flanges of said stud abut against said flanges of said sole plate when said tab of said sole plate is physically attached to said web of said stud.

2. The deflection wall as defined in claim 1, wherein said sole plate is metallic;

wherein said studs are metallic; and wherein said top plate is metallic.

3. The deflection wall as defined in claim 1, wherein said sole plate is straight; and wherein said top plate is straight.

4. The deflection wall as defined in claim 1, wherein a stud receives a tab of said top plate;

wherein said tab of said top plate abuts against one side of said web of said stud; and wherein said flanges of said stud abut against said flanges of said top plate.

5. The deflection wall as defined in claim 4, wherein said tab of said top plate is not physically attached to said web of said stud so as to allow said stud to axially float.

6. The deflection wall as defined in claim 4; further comprising an angle plate;

wherein said angle plate has one leg thereof abutted against the other side of said web of said stud so as to sandwich said web of said stud between said tab of said top plate and said one leg of said angle plate and prevent lateral floating of said stud; and wherein the other leg of said angle plate is physically attached by a screw to said web of said top plate to maintain said angle plate in position.

7. The deflection wall as defined in claim 1, wherein said tabs of said sole plate are stamped therefrom;

wherein said tabs extend perpendicularly upwardly from said sole plate;

wherein said tabs of said top plate are stamped therefrom; and wherein said tabs extend perpendicularly downwardly from said top plate.

8. The deflection wall as defined in claim 1, wherein said tabs of said sole plate are spaced longitudinally therealong at predetermined intervals so as to provide for spacing of said studs; and wherein said tabs of said top plate are spaced longitudinally therealong at predetermined intervals so as to provide for spacing of said studs.

9. The deflection wall as defined in claim 1, wherein said sole plate is identical to said top plate.

10. The deflection wall as defined in claim 1, wherein said sole plate and said top plate are so configured so as to allow pairs thereof to be inversely interlockingly stacked together for transport and for concealing therein said tabs thereon that have sharp edges.

* * * * *